US007540951B2

(12) United States Patent
Selmen et al.

(10) Patent No.: US 7,540,951 B2
(45) Date of Patent: Jun. 2, 2009

(54) INTEGRATED SCHEME OF PROCESSES FOR EXTRACTING AND TREATING AN EXTRA-HEAVY OR BITUMINOUS CRUDE

(75) Inventors: Arnault Selmen, Jonage (FR); Thierry Gauthier, Brignais (FR); Mathieu Pinault, Lyons (FR); Eric Benazzi, Chatou (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 218 days.

(21) Appl. No.: 11/508,331

(22) Filed: Aug. 23, 2006

(65) Prior Publication Data

US 2007/0045155 A1 Mar. 1, 2007

Related U.S. Application Data

(63) Continuation-in-part of application No. 11/473,315, filed on Jun. 23, 2006, now abandoned.

(30) Foreign Application Priority Data

Jun. 23, 2005 (FR) ..... 05/06.395

(51) Int. Cl.
*C10G 65/02* (2006.01)

(52) U.S. Cl. ..... 208/49; 208/45; 208/131; 208/216 PP; 208/309; 208/390; 166/267; 166/272.3; 166/279

(58) Field of Classification Search ..... 166/267, 166/272.3, 279; 208/45, 49, 131, 216 PP, 208/309, 390

See application file for complete search history.

(56) References Cited

U.S. PATENT DOCUMENTS 4,875,998 A * 10/1989 Rendall ..... 208/390
5,435,908 A * 7/1995 Nelson et al. ..... 208/216 PP
5,711,870 A * 1/1998 Storm et al. ..... 208/131
6,357,526 B1 * 3/2002 Abdel-Halim et al. ... 166/272.3

* cited by examiner

*Primary Examiner*—Glenn Caldarola
*Assistant Examiner*—Prem C. Singh
(74) *Attorney, Agent, or Firm*—Millen, White, Zelano & Branigan, P.C.

(57) ABSTRACT

A process for preparation of synthetic crude from a deposit of heavy crude, comprises: (a) the extraction of heavy crude by technology using steam; (b) the separation of crude extract and water; (c) the separation of crude into at least one light fraction and one heavy fraction; (d) the conversion of the heavy fraction of separation into a lighter product, said converted product, and a residue; (e) optionally, the partial or total hydrotreatment of the converted product and/or the light fraction (or fractions) obtained during the separation c), (f) the combustion and/or gasification of the conversion residue; the converted product and the light fraction (or fractions) for separation, optionally having been subjected to a hydrotreatment e), constituting the synthetic crude; said combustion allowing the generation of steam and/or electricity and said gasification allowing the generation of hydrogen; the steam and/or electricity thus generated being used for the extraction a) and/or the electricity and/or hydrogen thus generated being used for the conversion d) and/or the hydrotreatment e).

20 Claims, 4 Drawing Sheets

INTEGRATED SCHEME OF PROCESSES FOR EXTRACTING AND TREATING AN EXTRA-HEAVY OR BITUMINOUS CRUDE

This application is a continuation-in-part of application Ser. No. 11/473,315 filed Jun. 23, 2006 now abandoned, and claims the priority of French application No. 05/06.395 filed Jun. 23, 2005.

The invention relates to a process for preparation of synthetic crude from a deposit of heavy crude or bituminous crude. More particularly, it relates to an integrated scheme of a process for extracting heavy crude and a process for treating this extracted heavy crude that makes it possible to minimize the outside energy supply while providing a synthetic crude of very satisfactory quality.

This invention relates to extra-heavy or bituminous crudes, also referred to in this application by heavy crudes or bituminous crudes. These extra-heavy crudes represent considerable resources that increasingly are and will be exploited. These crudes, however, exhibit physical properties, in particular very high viscosity and density, which make their extraction, their production, their transport and their treatment very difficult.

Such crudes therefore cannot be extracted by standard methods.

Extraction methods that are specific to this type of crude have therefore been developed. One, suitable for surface or shallow deposits, called a mining extraction method, consists in mixing sand with the crude to be extracted and in extracting the mixture of sand and crude mechanically. This mixture is then washed, separated, and the lightest fractions are then upgraded.

This method is unsuitable for deeper deposits, and it is necessary to assist the on-site production so as to make them mobile, i.e., so as to reduce their viscosity to make their extraction possible.

To reduce the viscosity, the earth is reheated by steam injection, and the crude, thus made mobile, can be extracted. These so-called steam injection-assisted production methods (or according to English terminology "steam-assisted gravity drainage (SAGD)") or the cyclic steam injection-assisted production methods (or according to English terminology "cyclic steam simulation (CSS)") were described in U.S. Pat. Nos. 4,344,485, 4,850,429 and 5,318,124. These methods, although widely used, offer the major drawback of consuming very large quantities of natural gas required to produce injected steam. Their profitability is therefore largely dependent on the price of natural gas.

Furthermore, the thus extracted crudes are highly loaded with asphaltenes and heteroatoms (S, N, O, V, Ni, . . . ). They should therefore be treated for providing synthetic crudes of satisfactory quality, i.e., exhibiting a viscosity and a density that make possible their transport via pipeline, and a low content of sulfur and other heteroatoms. The upgrading stages are also very intensive in natural gas, which is necessary in particular for the production of hydrogen by steam reforming of natural gas or methane (steam methane reforming according to English terminology).

So as to minimize this dependence with regard to natural gas, a method was proposed in the patent U.S. Pat. No. 4,399,314 in which a bitumen originating from a bituminous sand undergoes hydroconversion, and the hydroconversion residue is gasified with oxygen so as to produce a synthesis gas from which hydrogen is produced for the hydroconversion stage.

The patent U.S. Pat. No. 6,357,526 proposes carrying out deasphalting for recovering a deasphalted crude that constitutes the synthetic crude, and the asphalt is burned to generate the steam that is used in the SAGD extraction process. The synthetic crude that is obtained is not of good quality, however, because it also contains many contaminants such as sulfur, nitrogen, and metals.

There therefore exists a real need for a process for preparation of synthetic crude from a deposit of extra-heavy or bituminous crude that makes possible the production of a quality synthetic crude whose dependence with regard to the price of natural gas is reduced and even canceled out.

These inventors found that it was possible to meet such a need thanks to a process integrating the extraction and treatment stages, the combustion and/or gasification of the conversion residue making it possible to generate energy in the form of steam or electricity and/or hydrogen, whereby the steam is then used for extraction and hydrogen for treatment.

More particularly, the invention relates to a process for preparation of synthetic crude from a deposit of heavy crude, comprising:

a) The extraction of heavy crude by a technology using steam;
b) The separation of extracted crude and water;
c) The separation of crude into at least one light fraction and one heavy fraction;
d) The conversion of the heavy fraction of separation into a lighter product, said converted product, and a residue;
e) Optionally, the partial or total hydrotreatment of the converted product and/or the light fraction (or fractions) obtained during the separation c);
f) The combustion and/or gasification of the conversion residue;

the converted product and the light fraction (or fractions) of separation, optionally having been subjected to a hydrotreatment e), constituting the synthetic crude;

said combustion allowing the generation of steam and/or electricity, and said gasification allowing the generation of hydrogen;

the steam and/or electricity thus generated being used for the extraction a), and/or the electricity and/or hydrogen thus generated being used for the conversion d) and/or the hydrotreatment e).

BRIEF DESCRIPTION OF DRAWINGS

The process of the invention is illustrated by the drawings in which.

Figure 1:
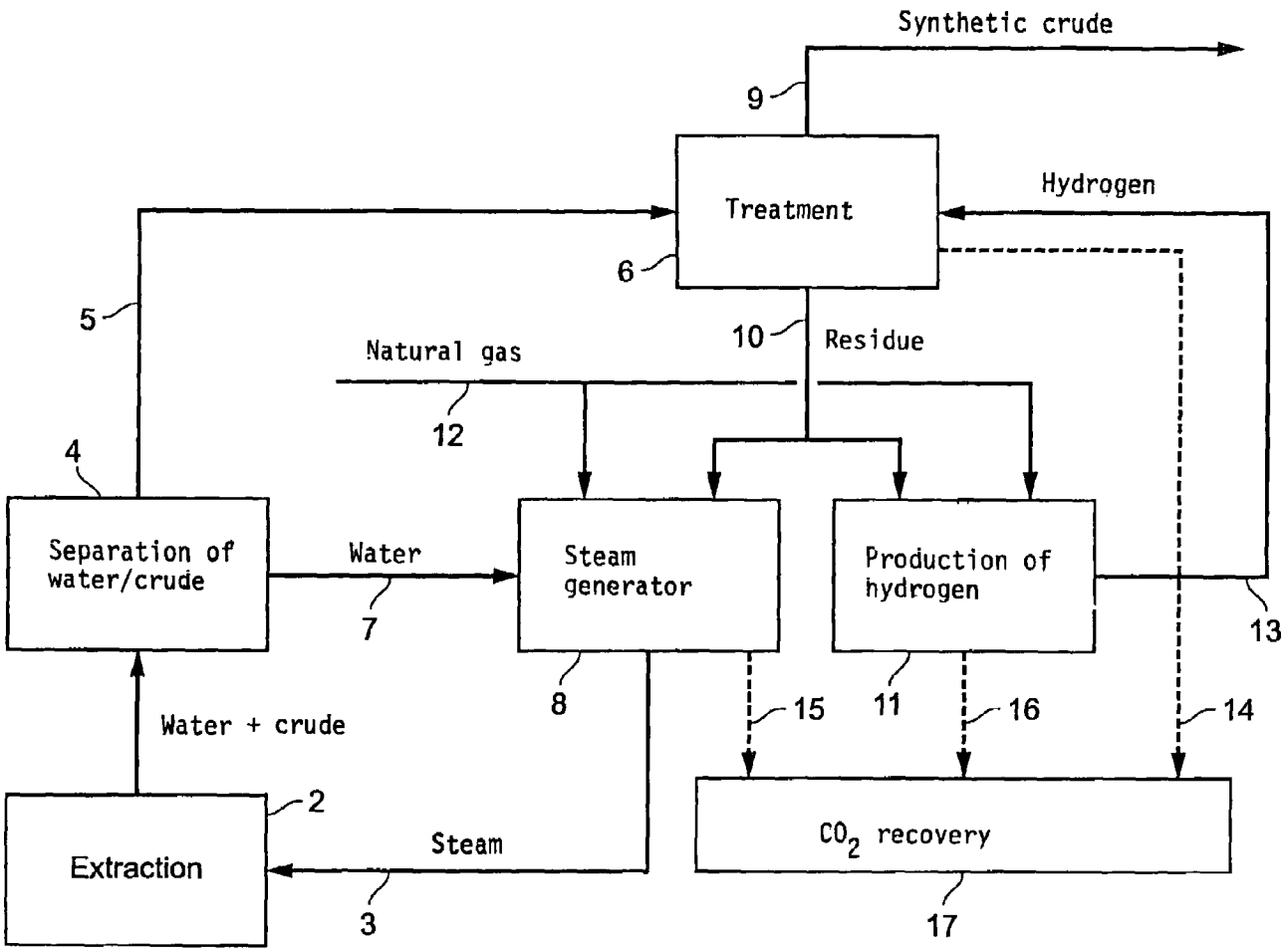
FIG. 1 is a block diagram outlining the scheme of different stages of the integrated preparation process of synthetic crude from a deposit of heavy crude.

Because of the combustion of the conversion residue, energy in the form of steam or electricity is generated in suitable quantities to meet completely or partially the needs of the extraction phase and/or also the conversion phase and optionally hydrotreatment, and because of the gasification, hydrogen is generated in suitable quantities to meet completely or partially the conversion phase and optionally the hydrotreatment.

The process according to the invention therefore makes it possible to reduce and even eliminate the need for the consumption of natural gas that is conventionally used for the generation of steam and hydrogen.

Thus, according to local conditions of processing and the economic context, the process can eliminate any consumption of natural gas and can minimize the final quantity of non-upgradable residue.

Or else in other conditions, it makes it possible to partially eliminate the consumption of natural gas.

The process according to the invention also allows a high adaptability to geo-economic conditions.

The fact of using the conversion residue to produce steam and/or hydrogen and/or electricity can also be reflected by a substantial investment savings necessary to the conversion installations. Actually, the capacities of the conversion installations can be limited, on the one hand, because the separation residue can also be used to generate the steam and/or the electricity and/or the hydrogen, and, on the other hand, because the required conversion level can be limited, whereby the operating conditions of the conversion can then be less strict (in particular, reduction of the dwell time).

Thus, according to an advantageous embodiment of the process of the invention, the conversion level of the conversion d) is adjusted so that the combustion and the gasification f) make it possible to generate at least 50% of the quantity of steam necessary for the extraction a) or at least 50% of the quantity of hydrogen that is necessary for the conversion d) and optionally for the hydrotreatment e), preferably all of the steam necessary for the extraction a) or all of the hydrogen necessary for the conversion d) and optionally for the hydrotreatment e), more preferably still all of the steam necessary for the extraction a) and at least one 50%, preferably 100%, of the quantity of hydrogen necessary for the conversion d) and optionally for the hydrotreatment e), and still more preferably, all of the steam necessary for the extraction a), all of the hydrogen necessary for the conversion d) and optionally for the hydrotreatment e), and the electricity that is necessary for the extraction a) and the conversion d) and optionally the hydrotreatment e).

In this invention, the "raw conversion rate" is defined as being the ratio by mass between (the feedstock entering the upgrading stage—the residue obtained) and the incoming feedstock. The "$T540^+$ conversion" is defined as [(the quantity of product with a boiling point>=540° C. entering into the reactor)−(the quantity of product with a boiling point>=540° C. exiting the reactor)]/(quantity of product with a boiling point>=540° C. entering into the reactor), whereby the quantities are expressed by mass.

In the process according to the invention, the extraction a) is carried out according to a continuous steam injection-assisted or SAGD (steam-assisted gravity drainage) production technology or a cyclic vapor-injection-assisted or CSS (cyclic steam stimulation) production technology, i.e., by technologies requiring very large quantities of steam and therefore of energy.

In the process according to the invention, the separation c) implements at least one physical separation process such as distillation or solvent extraction.

The distillation can be an atmospheric pressure distillation or else an atmospheric pressure distillation followed by a vacuum distillation. The atmospheric distillation can also be followed by a deasphalting, i.e., a solvent extraction separation.

The heavy fraction resulting from these separation operations that contains asphaltenes is then upgraded for providing lighter products.

The conversion d) can be thermal or catalytic.

Following the conversion d), the converted fractions that are obtained and/or the light fractions that are obtained from the separation c) can be hydrotreated e), i.e., enriched with hydrogen in the presence of catalysts, so as to stabilize them and to withdraw a portion of the heteroatoms. This hydrotreatment operation e) is hydrogen-intensive.

Figure 2:
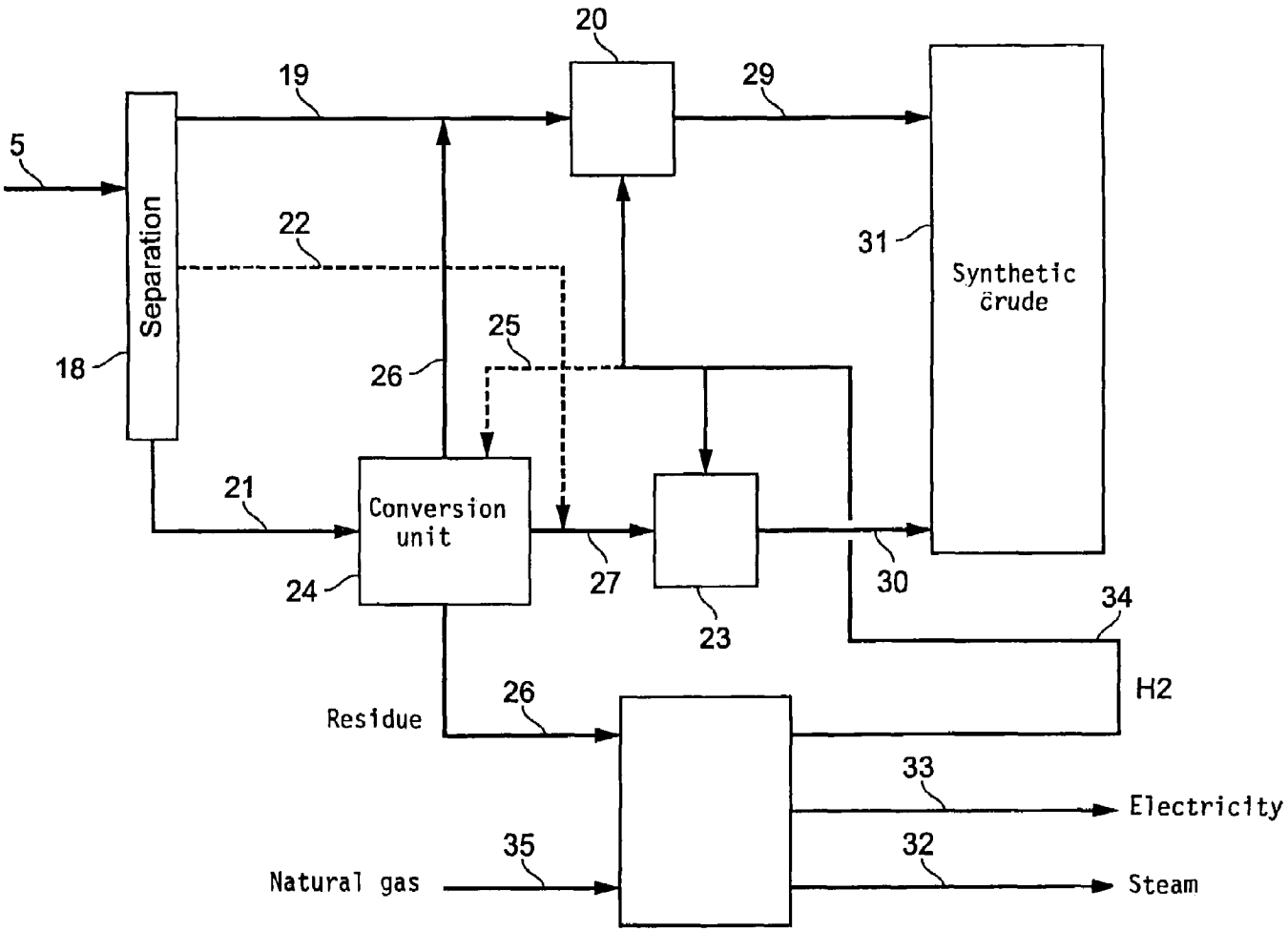
FIG. 2 is a block diagram outlining the treatment stage that comprises the separation c), the conversion d), and optionally the hydrotreatment e)

The general process of the invention is described in reference to FIGS. 1 and 2. FIG. 1 comprises different blocks that are representative of a unit for conducting the process. Block 2 represents the extraction that is done with steam 3. According to the SAGD or CSS process, the steam injection 3 in the extraction zone produces a mixture of water and crude that is separated in 4. The thus isolated crude 5 is transferred to the upgrading zone, and water 7 is recycled in the steam generation zone 8 where it is treated and then vaporized after an optional supply of water.

In the treatment zone 6, the crude is treated by (i) separation, (ii) hydroconversion and (iii) optionally hydrotreatment, thus making possible the production, on the one hand, of the synthetic crude 9 that is routed to other zones for extraction via pipeline operation zones, and, on the other hand, a non-upgradable residue 10 that will be burned to generate steam 8 and/or that will be gasified with natural gas 12 to generate hydrogen 11. This generation of steam and hydrogen is done either by combustion or gasification of the residue 10 or by combustion or gasification of the residue 10 and supply of natural gas 12.

The thus generated steam 8 is sent via 3 to the extraction zone 2. The hydrogen that is produced is sent to the treatment zone 6 via the line 13. The carbon dioxide that is formed during the treatment 6, the steam generation 8 and the hydrogen formation 11 is sent via respectively lines 14, 15, and 16 to a zone 17 for recovering carbon dioxide containing, for example, a $CO_2$-selective absorption/desorption zone using amines, then a $CO_2$ storage section.

The treatment zone 6 is described in more detail in FIG. 2. The separated heavy crude in line 5 in FIG. 1 that is obtained from the production by SAGD or CSS feeds a separation unit 18. At least one light fraction 19 is recovered at the top of this separation unit 18, and the heavy fraction 21 is recovered at the bottom. A portion of the light fraction (or fractions) can optionally be sent to the separation site 4 and can be mixed with crude to facilitate its transport upstream from the separation. The separation unit 18 can be an atmospheric distillation column; the light fraction (or fractions) is (or are) then called atmospheric residue (RAT). Unit 18 can also consist of an atmospheric distillation column and a vacuum distillation column. In this case, the heavy fraction that is obtained from the atmospheric distillation column feeds the vacuum distillation column (not shown); the heavy fraction that is obtained is called a vacuum residue (RSV).

The separation unit 18 can also consist of an atmospheric distillation column followed by a deasphalting unit. In this case, the atmospheric distillates are recovered at the top of the distillation column via 19, and the atmospheric distillation heavy fraction feeds the deasphalting unit (not shown). The deasphalting residue, called asphalt, then feeds line 21 that is described in FIG. 2. The deasphalted oil (DAO) feeds line 22 in FIG. 2.

The light fractions or atmospheric distillates essentially consist of naphtha, kerosene and gas oil.

The heavy fraction in line 21 that is obtained from the separation is treated in the unit 24 for conversion of heavy fractions, for example by cracking. This unit can be a thermal conversion unit (shown in FIG. 3) or a catalytic conversion unit (shown in FIG. 4). When this conversion requires a supply of hydrogen (catalytic conversion), the hydrogen can be brought in by flow 25 in dotted lines.

This conversion in the 24 leads to producing different fractions ranging from light fractions to so-called heavy residue fractions. The flow 26 represents the light fraction that essentially contains the naphtha, kerosene and gas oil-type products that are obtained from the conversion process 24. The flow 27 contains a heavier fraction that represents the vacuum distillate, and the flow 28 contains the residue that is obtained from the conversion unit 24.

The naphtha, kerosene, and gas oil fractions of flows 19 and 26 are mixed and can feed the hydrotreatment unit 20 that makes it possible to improve the quality of these fractions by reducing the sulfur content and the nitrogen content while stabilizing these products. The flow 29 represents the naphtha, kerosene and hydrotreated gas oil fraction obtained from the hydrotreatment unit 20.

The vacuum distillate fraction 27 that is obtained from the conversion unit 24 and optionally the vacuum distillate 22 (which exists when the separation section comprises a vacuum distillation) feed the hydrotreatment unit 23 so as to undergo an intensive hydrotreatment and to reduce the content of heteroatoms such as sulfur and nitrogen. The flow 30 represents the vacuum distillate fraction after hydrotreatment in the unit 23.

The flow 29 and the flow 30 are mixed. They thus constitute the synthetic crude 31.

The steam 32, the electricity 33 and the hydrogen 34 can be produced from the natural gas 35. The steam 32 is produced by a boiler with gas and hydrogen 33 via a steam methane reforming.

To eliminate all or part of the natural gas 35, the conversion level of the conversion unit 24 is adjusted to produce enough residue 28 so as to produce hydrogen 34 and/or steam 32 and/or the electricity 33 completely or partially.

The steam 32 can be produced by combustion in a boiler or by gasification of the residue but it preferably can be produced by combustion in a boiler. The generated steam can partially feed a turbine so as to produce electricity 33 or the synthesis gas produced by gasification can partially feed a gas turbine so as to produce electricity 33.

The hydrogen 34 can be produced by gasification of the residue 28. A portion of the synthesis gas that is produced can then feed a gas turbine so as to produce the electricity 33.

The hydrogen that is produced then feeds the hydrotreatment units 20 and 23 and optionally the conversion unit 24, if necessary via 25.

The generated steam is pumped to the petroleum deposit where it will make possible the heating of the crude and thus the reduction of its viscosity.

According to a particular embodiment of the invention, the thermal conversion comprises coking.

Figure 3:
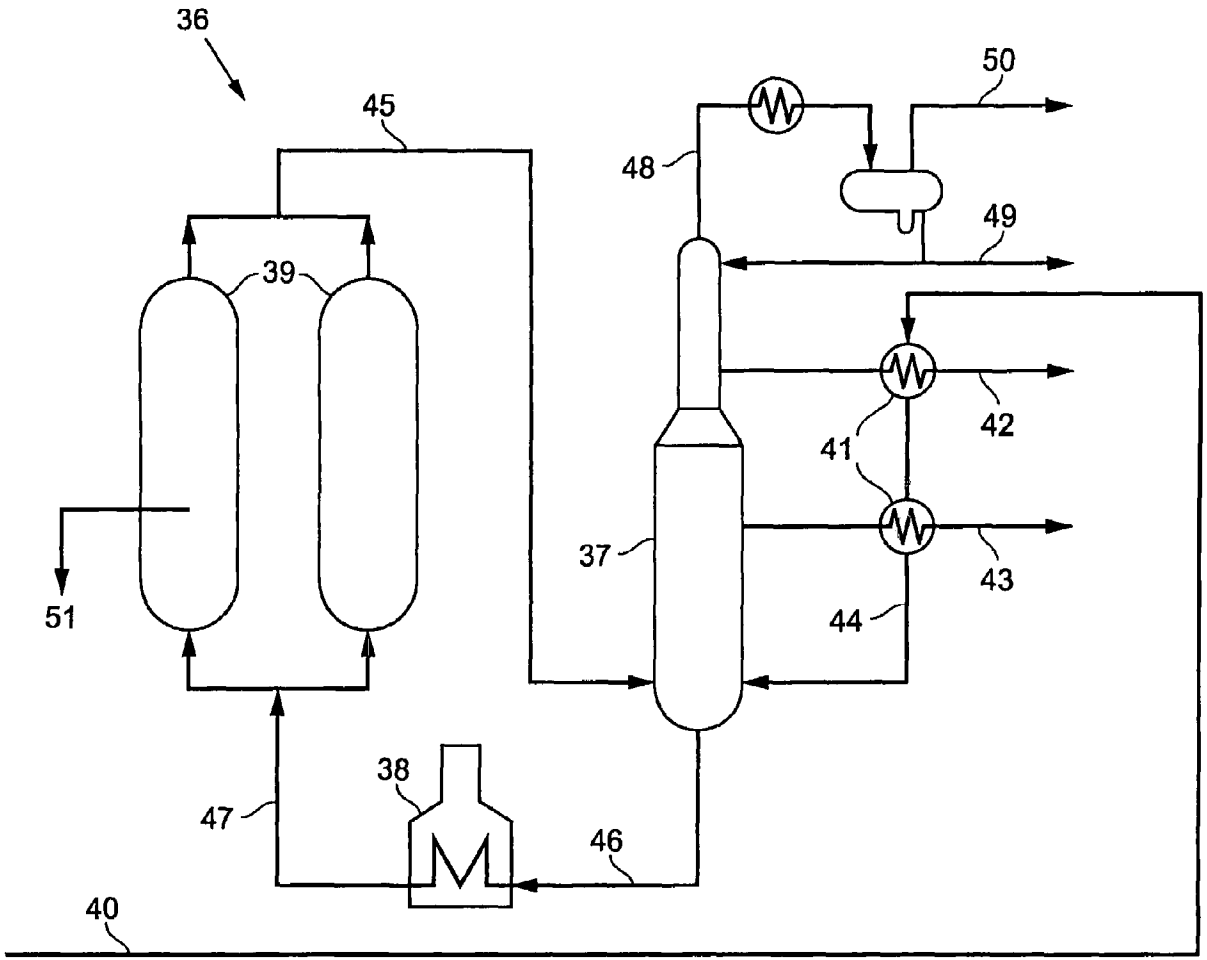
FIG. 3 is a schematic flowsheet outlining the conversion stage c) when the latter implements coking.

A coking unit is shown diagrammatically in FIG. 3. FIG. 3 shows a conversion unit example 24 of FIG. 2. This conversion unit is a coking unit 36. This coking unit 36 comprises at least one fractionation section 37, a cracking furnace section 38 and an aging section 39.

In this FIG. 3, the fractionation section 37 consists of a distillation column. This fractionation section, however, can also consist of a succession of successive distillation columns.

In this FIG. 3, the cracking furnace section 38 consists of a single cracking furnace. Based on the flow to be treated, temperatures to be reached and the volume of the furnace, however, it may consist of at least two furnaces placed in a series or in parallel.

The aging section 39, as shown in FIG. 3, comprises at least two reactors (called aging reactors or cokers according to English terminology). These reactors operate alternately, whereby one is in a so-called decoking phase, i.e., for recovery of the coke formed when it was in use, while the others are in use.

The feed to the coking unit 36 is a residue 40 (which corresponds to 21 in FIG. 2). This residue is preferably a vacuum residue. The feedstock 40 is preheated in the heat exchangers 42 so as to recover the energy of flows 42 and 43 that are obtained from the fractionation 37. The thus preheated feedstock 44 feeds the bottom of fractionation column 37 with the effluent 45 that is obtained from the aging section 39. The heavy fraction 46 of this fractionation section 37 that contains, among others, the feedstock 44 feeds the cracking furnace 38.

Flow 47 that exits from furnace 38 feeds one or more aging reactors 39. The effluent 45 that is recovered at the outlet of the aging tank 39, cracked effluent, is sent into a fractionation section 37 to be separated into different fractions, a gas fraction 48 that is recovered at the top of the column, liquid fractions 49, 42, and 43 of various boiling points, and a heavy fraction 46 that is recycled in the cracking furnace 38.

The coke that is drawn off from aging tanks 39 is recovered at 51 to be processed, burned, or gasified on site to generate energy.

Advantageously, in the process according to the invention, coking is used on the heavy fraction of a vacuum residue. The coking conditions are as follows: the temperature at the outlet of the furnace is more than 460° C., preferably 480° C. to 510° C., the absolute pressure in the furnace is less than 5 bar, preferably 1 to 3 bar, and the recycling rate, i.e., the flow fraction that has undergone coking (line 45 in FIG. 3) that returns to the coking furnace after fractionation is less than 20%, preferably less than 10%. These operating conditions can be degraded so as to produce a little more coke, if necessary, for the production of the vapor for the SAGD extraction or hydrogen.

The coke product corresponds to 20% to 35% of the feedstock entering the coking unit according to the nature of the feedstock and the operating conditions, which corresponds to a raw conversion rate of the coking of 65 to 80%. If this raw conversion rate is inadequate for ensuring all of the needs of steam and hydrogen and/or electricity, a fraction, preferably a heavy fraction that is obtained from the coker, can also be used for supplementing the quantity of fuel.

This thermal conversion unit can also be a visbreaking unit. The visbreaking can also be carried out in the presence of hydrogen so as to promote the stability of the products. Hydrovisbreaking is then mentioned. $T540^+$ conversions of 25% to 45% can be obtained. This unit comprises at least one cracking furnace section and a section for fractionation of cracked products. Preferably, it also comprises an aging section. The feedstock entering the visbreaking unit, which can be an atmospheric residue or a vacuum residue, passes into the cracking furnace section so as to bring the hydrocarbons to a temperature of between 430° C. and 510° C., preferably between 470° C. and 500° C. In the presence of the aging section, this temperature at the furnace outlet can be lowered and is between 440° C. and 470° C.

According to another advantageous embodiment of the process of the invention, the catalytic conversion is a catalytic hydroconversion.

The catalytic conversion process can be a ebullated-bed or slurry hydroconversion process. The feedstock may be an atmospheric residue or a vacuum residue. The conversion rate $T540^+$ of this type of process may go from 20% to 95%. This hydroconversion process preferably consists of at least one furnace section for preheating the feedstock and the hydrogen, a reaction section in which the conversion is carried out, and a fractionation section in which the effluent of the reaction section is separated into different fractions.

The operating conditions of the catalytic conversion reaction section are in general a total pressure of 10 to 500 bar, preferably 60 to 200 bar; a partial hydrogen pressure of 10 to 500 bar, preferably 60 to 200 bar; a temperature of 300° C. to 600° C., preferably 380° C. to 450° C., and a residence time ranging from 5 minutes to 20 hours, preferably 1 hour to 10 hours.

The reaction section preferably consists of at least one reaction chamber in which a gaseous phase, a liquid phase and a solid phase are brought into contact. The gaseous phase, in a variable portion, contains at least the hydrogen and hydrocarbons that are vaporized under the conditions of the process. The liquid phase consists of non-vaporized hydrocarbons. The solid phase that is contained in the reactor preferably has a catalytic action under the reaction conditions. The solid is preferably within the liquid phase.

In this ebullated-bed embodiment, the process uses a supported catalyst and contains at least one metallic element. The catalyst remains in the reactor and is added or drawn off independently of the feedstock.

In the slurry reactor embodiment, the catalyst is generally introduced continuously with the fresh feedstock into the reactor and consists of soluble elements that contain one or more metals that can be sulfurized under the conditions of the process.

The sulfurization of the metals causes the precipitation of the metal that dwells in the reactor in the form of fine and dispersed particles that can be entrained by the liquid outside of the reaction zone.

Very preferably, the solid catalyst particles contain molybdenum.

In the case where the conversion process uses slurry mode particles, the combustion and the gasification of the residues are provided so as to allow the recovery of metals of the catalyst in the ashes or smoke. Actually, the catalyst that is used in the slurry reactor hydroconversions is concentrated after separation of the effluents in said residues.

The $T540^+$ conversion rate of this type of process can range from 20% to 95%. $T540^+$ conversion rate is defined as: [(the quantity of product with boiling point>=540° C. entering into the reactor)−(the quantity of product with boiling point>=540° C. exiting from the reactor)]/(the quantity of product with boiling point>=540° C. entering into the reactor), whereby the quantities are defined by mass.

According to an advantageous embodiment of the process of the invention, the conversion rate of 540° C. of the catalytic hydroconversion is 65% to 85%; the combustion of the residue can then make it possible to produce the steam necessary to the extraction a) or hydrogen used for the upgrading d) and optionally the hydrotreatment e). If the conversion rate is 50% to 70%, then both steam necessary to the extraction a) and hydrogen used for the upgrading d) can be produced.

Figure 4:
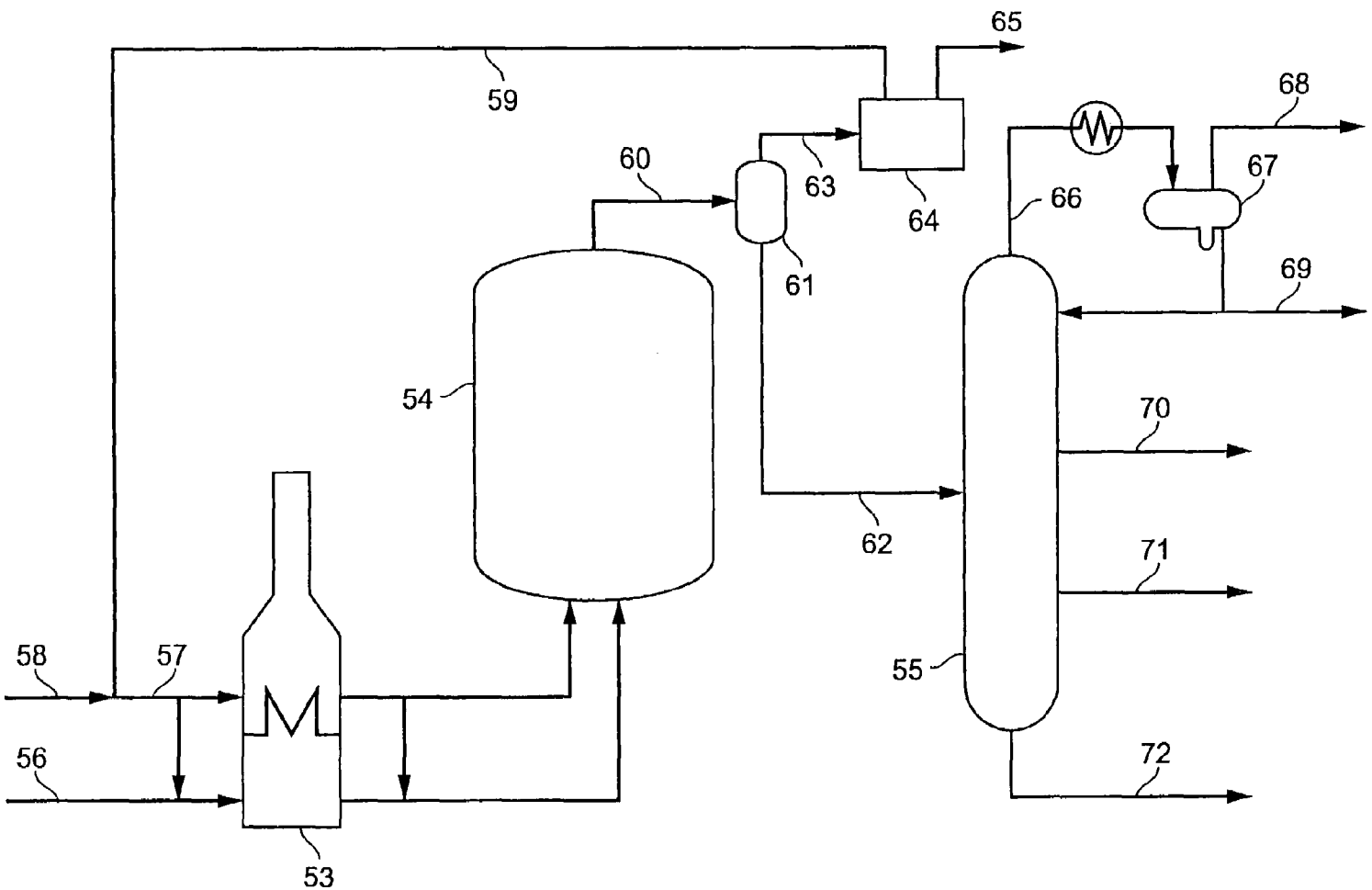
FIG. 4 is a schematic flowsheet outlining the conversion stage c) when the latter implements a catalytic hydroconversion process.

A hydroconversion example is illustrated in FIG. 4. FIG. 4 corresponds to the conversion unit 24 of FIG. 2, whereby this conversion unit is a catalytic conversion unit 52.

This catalytic conversion unit comprises a preheating section 53, a reaction section 54 and a fractionation section 55.

The preheating section 53 can be composed of one or more furnaces.

The reaction section 54 consists of one or more reactors placed in a series and/or in parallel. In the case of reactors in a series, one or more separators may be placed between the reactors so as to eliminate the hydrocarbon gases that are formed.

The feedstock 56 is a heavy residue that can be, for example, an atmospheric residue or a vacuum residue. The feedstock 56 is preheated in the furnace 53. The necessary hydrogen 57 is the mixture between the make-up hydrogen 58 and the recycled hydrogen 59. This mixture is preheated in the furnace 53.

All or part of the hydrogen can be mixed with the feedstock before the furnace, after the furnace or even injected directly into the reactor 54.

The hydrogen 57 and the feedstock 56 feed the reaction section 54. In the reaction section, all or a portion of the hydrogen can be fed into a single reactor, into some reactors, or into all of the reactors and this in part variable.

The flow 60 that is drawn off from the reaction zone 54 feeds a tank 61 that makes it possible to separate the liquid phase 62 from the gas phase 63.

The gas phase 63 is directed to the purification section of the hydrogen 64. The purified hydrogen is recycled via the flow 59; the remaining gases are evacuated via 65. The liquid phase 62 feeds the fractionation section 55. The liquid phase is then fractionated into various fractions with different boiling points. At the top of column 66, the light gases are drawn off and condensed at 67 to provide gases 68 that are recovered. Other intermediate products such as the liquid fractions 69, 70, and 71 are possible. At the bottom of the column, the residue 72 is drawn off. A linking of columns operating at atmospheric pressure then under vacuum is possible to complete the fractionation. At least one portion of the residue 72 and optionally at least one portion of the fractions 69, 70 or 71 can be recycled either before the furnace section with the feedstock 56 or before the reaction section or during the reaction section when the latter comprises several reactors. It is also possible to inject imported fractions containing significant quantities of aromatic or polyaromatic compounds into the preheated zone, the reaction zone or the fractionation zone of the hydroconversion process to improve the stability of the liquid hydrocarbon effluents.

The process according to the invention is intended for the extraction and the upgrading of extra-heavy crude, i.e., having a viscosity of more than 100 CPo and a density of less than 20° API, preferably a viscosity of more than 1,000 CPo and a density of less than 15° API and more preferably a viscosity of more than 10,000 CPo and a density of less than 12° API.

This process is thus particularly suited to heavy crudes such as those of Athabasca, Zuata, Cerronegro, or Morichal type.

The synthetic crude that is obtained at the end of the process of the invention has a viscosity and a density such that it can be transported via pipeline operation zones, whereby the relative density is at most 0.94 under standard conditions (4° C.) and at least 19° API, and the viscosity is less than 350 cst at 4° C.

Further, it exhibits reduced contents of heteroatoms and metals.

The invention will be described in more detail with the examples and comparison example that are given below by way of illustration and that are not limiting.

In the following Tables D4.15 stands for relative density (specific gravity) at 15° C. according to NFT 60-101. °API stands for API gravity: a measure of heaviness of petroleum related to density and specific gravity [°API=(141.5/specific gravity at 60° F.)−131.5].

EXAMPLES

Example 1 (For Comparison)

Athabasca-type heavy or bituminous crude is drawn off via an SAGD-type process with 1350 t/h of steam generated from 104 t/h of natural gas. After separation of water and crude, the crude is subjected to an atmospheric distillation. The atmospheric residue (RAT) that is obtained exhibits the characteristics that are provided in Table 1 below.

This atmospheric residue undergoes a hydroconversion under the following conditions:

Mean temperature: 426° C.

Partial $H_2$ pressure: 130 bar

T540 conversion: 0.95

The hydrogen supply for the upgrading is an outside supply of hydrogen obtained by steam methane reforming of natural gas. 28 t/h of hydrogen is necessary, which corresponds to a consumption of 95 t/h of natural gas.

The material balance of the hydroconversion is as follows:

| | % by Weight |
|---|---|
| RAT | 100.0 |
| $H_2$ | 4.08 |
| $NH_3$ | 0.34 |
| $H_2S$ | 5.53 |
| $C_1$-$C_4$ | 12.05 |
| $C_5$-370 | 65.35 |
| 370-500 | 15.03 |
| $500^+$ | 5.78 |
| Total | 104.08 |
| Liquid | 86.16 |

The characteristics of the crude obtained after hydroconversion are also given in Table 1.

The product that has undergone hydroconversion and the light fraction of the atmospheric distillation are mixed after hydrotreatment to provide the synthetic crude whose characteristics are also summarized in Table 1.

TABLE 1

| | D4.15 | °API | S (by Weight) |
|---|---|---|---|
| RAT | 1.029 | 6.0 | 5.42% |
| After Hydroconversion | 0.84 | 37.7 | 0.25% |
| Synthetic Crude | 0.86 | 39.4 | 730 ppm |

107,500 BPSD of synthetic crude at 39.4° API was thus produced with an overall consumption of natural gas of 199 t/h.

Example 2

Athabasca-type heavy or bituminous crude is drawn off via an SAGD-type process. After separation of water and crude, the crude is subjected to an atmospheric distillation. The atmospheric distillation results in a residue (RAT) which exhibits the characteristics in Table 2 below. This atmospheric residue then undergoes a hydroconversion.

The conversion rate of the hydroconversion is adjusted so as to use the necessary quantity of residue (500° C.+) so as to feed the boiler to produce the steam that is necessary for the production of heavy or bituminous crude.

To produce 100,000 BPSD of heavy or bituminous crude by SAGD, knowing that the steam/crude ratio produced is 2 barrels of steam per barrel of crude, it then will be necessary to inject nearly 1350 t/h of steam into the crude-containing area.

To satisfy this steam demand, the conversion level of the hydroconversion should lead to using 123,000 kg/h of residue to feed the boiler. The conversion rate of the hydroconversion should therefore be 77.6%.

The hydroconversion conditions are therefore as follows:

Mean temperature: 421° C.

Partial $H_2$ pressure: 130 bar

T540 conversion: 0.776

The make-up hydrogen for the upgrading is an outside make-up hydrogen obtained by steam methane reforming of natural gas. 19 t/h of hydrogen is necessary, which corresponds to a consumption of 66 t/h of natural gas.

The characteristics of the crude after hydroconversion are provided in Table 2 below.

The material balance of the hydroconversion is as follows:

| | % by Weight |
|---|---|
| RAT | 100.0 |
| $H_2$ | 2.69 |
| $NH_3$ | 0.19 |
| $H_2S$ | 5.04 |
| $C_1$-$C_4$ | 5.85 |
| $C_5$-370 | 49.75 |
| 370-500 | 21.01 |
| $500^+$ | 20.85 |
| Total | 102.69 |
| Liquid | 91.61 |

The light fraction that is obtained from the atmospheric distillation and the product that is obtained from the hydroconversion are collected after hydrotreatment to provide the synthetic crude whose characteristics are presented in Table 2 below.

TABLE 2

| | D4.15 | °API | S (by Weight) |
|---|---|---|---|
| RAT | 1.029 | 6.0 | 5.42% |
| After Hydroconversion | 0.89 | 27.7 | 0.74% |
| Synthetic Crude | 0.83 | 39.2 | 380 ppm |

90,500 BPSD of synthetic crude at 39.2° API was produced with a consumption of 66 t/h of natural gas.

Example 3

Athabasca-type heavy or bituminous crude is drawn off via an SAGD-type process. After separation of water and crude, the crude is subjected to an atmospheric distillation. The atmospheric distillation that is obtained (RAT) exhibits the characteristics that are provided in Table 3 below. This atmospheric residue undergoes a hydroconversion.

The conversion rate of the hydroconversion is adjusted so as to use the necessary quantity of residue (500° C.+) so as to feed the boiler to produce the steam that is necessary for the production of heavy or bituminous crude and the hydrogen that is necessary for the treatment.

To produce 100,000 BPSD of heavy or bituminous crude by SAGD, knowing that the steam/crude ratio produced is 2 barrels of steam per barrel of crude, it then will be necessary to inject nearly 1350 t/h of steam.

To satisfy this steam demand, the conversion level of the hydroconversion should lead to using 123 t/h of residue to feed the boiler. A portion of the residue is also used to produce hydrogen and electricity for the upgrading. 14 t/h of hydrogen is used. It is therefore necessary to gasify 77 t/h of residue to produce the necessary hydrogen and electricity. The total need for residue is 200 t/h, which leads to a conversion rate of the hydroconversion of 60.5%.

The hydroconversion conditions are therefore as follows:

Mean temperature: 415° C.

Partial $H_2$ pressure: 130 bar $T540^+$ conversion: 0.605

The characteristics of the crude after hydroconversion are provided in Table 3 below.

The material balance of the hydroconversion is as follows:

| | % by Weight |
|---|---|
| RAT | 100.0 |
| $H_2$ | 1.88 |
| $NH_3$ | 0.10 |
| $H_2S$ | 4.50 |
| $C_1$-$C_4$ | 3.56 |
| $C_5$-370 | 38.35 |
| 370-500 | 21.48 |
| $500^+$ | 33.89 |
| Total | 101.88 |
| Liquid | 93.71 |

The light fraction that is obtained from the atmospheric distillation and the product that is obtained from the hydroconversion are collected after hydrotreatment to provide the synthetic crude whose characteristics are presented in Table 3 below.

TABLE 3

| | D4.15 | °API | S (by Weight) |
|---|---|---|---|
| RAT | 1.029 | 6.0 | 5.42% |
| After Hydroconversion | 0.93 | 21.4 | 1.26% |
| Synthetic Crude | 0.84 | 37.5 | 450 ppm |

77,950 BPSD of synthetic crude at 37.5 ° API was produced without consumption of natural gas, in complete autonomy.

The light fraction from the hydroconversion unit or atmospheric distillation according to the invention has a boiling point up to about 370° C. and may include $C_1$-$C_4$ and $C_5$-370° C., for example naphtha, kerosene, and/or gas oil.

The "converted product" has a boiling point of about 370° C. to 500° C., similar to that of a vacuum residue.

The "conversion residue" has a boiling point above 500° C.

The entire disclosures of all applications, patents and publications, cited herein and of corresponding French application No. 05/06.395, filed Jun. 23, 2005 are incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. An integrated process for the preparation of synthetic crude from a deposit of heavy crude, comprising the following stages:

a) extracting heavy crude using steam said heavy crude having a viscosity of more than 100 cPo and a gravity of less than 20° API;

b) separating water from resultant mixture of extracted crude and water;

c) distilling separated extracted crude into at least one light fraction and one heavy fraction;

d) converting the at least one heavy fraction into a lighter product, a converted product, and a residue;

e) subjecting to hydrotreatment at least a portion of said converted product and the lighter product obtained during the separating step (c) of the extracted crude wherein the hydrotreatment is conducted on said at least a portion of the converted product in a first hydrotreatment zone, and on at least a portion of the lighter product in a second hydrotreatment zone separate from the first hydrotreatment zone; and combining non-hydrotreated converted and lighter products with resultant hydrotreated converted product and/or hydrotreated lighter product to form a syntheitc crude having a density of at most 0.94 under standard conditions, a gravity of at least 19° API, and a viscosity of less than 350 Cst at 4° C.;

f) performing combustion and/or gasification of the conversion residue; whereby the converted product and the light fraction (or fractions) constitute the synthetic crude;

g) said combustion of the conversion residue allowing the generation of steam and/or electricity and said gasification allowing the generation of hydrogen; providing at least part of the generated hydrogen to said hydrotreatment step (e); and providing the steam and/or electricity thus generated for the extracting of the heavy crude a) and/or the electricity and/or part of the hydrogen thus generated or for the conversion and separating of the heavy fraction d).

2. A process according to claim 1, characterized by the fact that the conversion rate of the conversion process d) is adjusted so that the combustion and the gasification f) make it possible to generate at least 50% of the quantity of steam necessary for the extraction a) or at least 50% of the quantity of hydrogen necessary for the conversion d) and for the hydrotreatment e).

3. A process according to claim 2, wherein the conversion rate of the conversion process d) is adjusted so that the combustion and the gasification f) make it possible to generate all of the steam that is necessary for the extraction a) or all of the hydrogen necessary for the conversion d) and for the hydrotreatment e).

4. A process according to claim 2, wherein the conversion rate of the conversion process d) is adjusted so that the combustion and the gasification f) make it possible to generate all of the steam necessary for the extraction a) and at least 50% of the quantity of hydrogen necessary for the conversion d) and for the hydrotreatment e).

5. A process according to claim 2, wherein the conversion rate of the conversion process d) is adjusted so that the combustion and the gasification f) make it possible to generate all of the steam necessary for the extraction a) and 100% of the quantity of hydrogen necessary for the conversion d) and for the hydrotreatment e).

6. A process according to claim 2, wherein the conversion rate of the conversion process d) is adjusted so that the combustion and the gasification f) make it possible to generate all of the steam necessary for the extraction a), all of the hydrogen necessary for the conversion d) for the hydrotreatment e) and the electricity that is necessary for the extraction a) and the conversion d) and optionally the hydrotreatment e).

7. A process according to claim 1, wherein the extraction a) is done according to a continuous steam injection-assisted production process or SAGD (steam assisted gravity drainage) or a cyclic steam injection-assisted production process or CSS (cyclic steam stimulation).

8. A process according to claim 1, wherein the separation c) comprises a distillation at atmospheric pressure.

9. An integrated process for the preparation of synthetic crude from a deposit of heavy crude, comprising the following stages:

a) extracting heavy crude using steam said heavy crude having a viscosity of more than 100 cPo and a gravity of less than 20° API;

b) separating water from resultant mixture of extracted crude and water;

c) distilling separated extracted crude into at least one light fraction and one heavy fraction wherein the distillation is at atmospheric pressure and is followed by a vacuum distillation;

d) converting the at least one heavy fraction into a lighter product, a converted product, and a residue;

e) subjecting to hydrotreatment at least a portion of said converted product and the lighter product pbtained during the separating step (c) of the extracted crude wherein the hydrotreatment is conducted on said at least a portion of the converted product in a first hydrotreatment zone, and on at least a portion of the lighter product in a second hydrotreatment zone separate from the first hydrotreatment zone; and combining non-hydrotreated converted and lighter products with resultant hydrotreated converted product and/or hydrotreated lighter product to form a synthetic crude having a density of at most 0.94 under standard conditions, a gravity of at least 19° API, and a viscosity of less than 350 Cst and 4° C.;

f) performing combustion and/or gasification of the conversion residue; whereby the converted product and the light fraction (or fractions) constitute the synthetic crude;

g) said combustion of the conversion residue allowing the generation of steam and/or electricity and said gasification allowing the generation of hydrogen; providing at least part of the generated hydrogen to said hydrotreatment step (e); and providing the steam and/or electricity thus generated for the extracting of the heavy crude a) and/or the electricity and/or part of the hydrogen thus generated or for the conversion and separating of the heavy fraction d).

10. A process according to claim 1, wherin the conversion d) comprises a thermal conversion or a catalytic conversion.

11. A process according to claim 10, wherein the thermal conversion comprises coking.

12. A process according to claim 11, comprising separating a heavy fraction from the coking process and recycling said heavy fraction to stage f).

13. A process according to claim 10, wherin the catalytic conversion is a catalytic hydroconversion.

14. An integrated process for the preparation of synthetic crude from a deposit of heavy crude, comprising the following stages:

a)extracting heavy crude using steam said heavy crude having a viscosity of more than 100 cPo and a gravity of less than 20° API;

b) separating water from resultant mixture of extracted crude and water;

c) distilling separated extracted crude into at least one light fractin and one heavy fraction;

d) converting by catalytic hydroconversion the at least one heavy fraction into a lighter product, a converted product, and a residue, wherein a supplemental imported feedstock that includes large quantities of aromatic or polyaromatic compounds is injected into a preheating zone, a reaction zone or a fractionation zone of the hydroconversion process to improve the stability of the hydrocarbon effluents;

e) subjecting to hydrotreatment at least a portion of said converted product and the lighter product obtained during the separating step (c) of the extracted crude wherein the hydrotreatment is conducted on said at least a portion of the converted product in a first hydrotreatment zone, and at least a portion of the lighter product in a second hydrotreatment zone separate from the first hydrotreatment zone; and combining non-hydrotreated converted and lighter products with resultant hydrotreated converted product and/or hydrotreated lighter product to form a synthetic crude having a density of at most 0.94 under standard conditions, a gravity of at least 19° API, and a viscosity of less than 350 Cst at 4° C.;

f) performing combustion and/or gasification of the conversion residue; whereby the converted product and the light fraction (or fractions) constitute the synthetic crude;

g) said conbustion of the conversion residue allowing the generation of steam and/or electricity and said gasification allowing the generation of hydrogen; providing at least part of the generated hydrogen to said hydrotreatment step (e); and providing the steam and/or electricity thus generated for the extracting of the heavy crude a) and/or the electricity and/or part of the hydrogen thus generated or for the conversion and separating of the heavy fraction d).

15. A process according to claim 13, wherein the catalytic hydroconversion is carried out in various reactors in series between which are placed one or more separators.

16. A process according to claim 10, wherein the thermal conversion is a visbreaking or a hydrovisbreaking.

17. A process according to claim 13, wherein the catalytic hydroconversion conversion rate results in a $T540^+$ conversion rate of 65% to 85%; the combustion of the residue provides the steam necessary for the extraction a) or the hydrogen used for the conversion d) and the hydrotreatment e).

18. A process according to claim 17, wherein the $T540^+$ conversion rate of the catalytic hydroconversion is 50% to 70%.

19. A process according to claim 11, wherein the raw conversion rate of the coking is 65 to 80% and provides the production of the steam, and/or the hydrogen is necessary for the extraction a) and for the upgrading d) and for the hydrotreatment e).

20. A process according to claim 1, wherein the at least a portion of the converted product comprises a vacuum distillate fraction.

* * * * *

UNITED STATES PATENT AND TRADEMARK OFFICE

CERTIFICATE OF CORRECTION

PATENT NO. : 7,540,951 B2
APPLICATION NO. : 11/508331
DATED : June 2, 2009
INVENTOR(S) : Selmen et al.

It is certified that error appears in the above-identified patent and that said Letters Patent is hereby corrected as shown below:

Column 13, line 28 reads "converted product and the lighter product pbtained dur-" should read -- converted product and the lighter product obtained dur- --.

Column 14, line 7 reads "fractin and one heavy fraction" should read -- fraction and one heavy fraction --.

Signed and Sealed this

Sixteenth Day of February, 2010

David J. Kappos

David J. Kappos
*Director of the United States Patent and Trademark Office*